United States Patent [19]

Nishioka et al.

[11] 4,095,059

[45] June 13, 1978

[54] INTERLOCKED PUSH-LOCK PUSH-BUTTON SWITCH ASSEMBLY HAVING CONDUCTIVE MUTING SPRING

[75] Inventors: Matsuo Nishioka; Shunzo Oka, both of Hirakata, Japan

[73] Assignee: Matsushita Electric Industrial Co., Ltd., Japan

[21] Appl. No.: 613,898

[22] Filed: Sep. 16, 1975

[30] Foreign Application Priority Data

Sep. 20, 1974 Japan ..... 49-114246[U]
Jun. 19, 1975 Japan ..... 50-84323[U]

[51] Int. Cl.[2] ..... H01H 9/26; H01H 13/72; H01H 1/18

[52] U.S. Cl. ..... 200/5 B; 200/5 E; 200/16 A; 200/50 C; 200/164 R; 200/241

[58] Field of Search ..... 200/5 E, 5 EA, 5 EB, 200/340, 11 E, 11 EA, 11 G, 11 J, 11 K, 11 TW, 16 A, 50 C, 153 J, 159 R, 159 A, 159 B, 165, 241–244, 291, 292, 275, 164 R, 248, 5 B, 1 LA

[56] References Cited

U.S. PATENT DOCUMENTS

| | | | |
|---|---|---|---|
| 2,506,987 | 5/1950 | Becwar | 200/16 A X |
| 2,854,552 | 9/1958 | Gouverneur | 200/292 X |
| 2,935,577 | 5/1960 | Dumke et al. | 200/5 E UX |
| 3,229,053 | 1/1966 | Smith | 200/159 R X |
| 3,517,140 | 6/1970 | Bailey et al. | 200/5 E |
| 3,591,740 | 7/1971 | Kolster | 200/11 J X |
| 3,706,863 | 12/1972 | Britton et al. | 200/5 E X |
| 3,767,878 | 10/1973 | Sykora | 200/159 R |
| 3,858,019 | 12/1974 | Muri et al. | 200/275 X |

*Primary Examiner*—James R. Scott
*Attorney, Agent, or Firm*—Burgess, Ryan and Wayne

[57] ABSTRACT

An interlocked push-lock push-button switch assembly of the type in which when one of the switch buttons each formed integral with an operating-bridging member is depressed, it is locked in pushed-down position so that the movable contacts are made into contact with the mating stationary contacts, but when another switch button is depressed, the switch which has been locked in position is released. An inverted U-shaped movable contact member with the movable contacts attached to the ends thereof is retained in position by a movable-contact-member retaining member formed integral with the operating-bridging member.

12 Claims, 12 Drawing Figures

INTERLOCKED PUSH-LOCK PUSH-BUTTON SWITCH ASSEMBLY HAVING CONDUCTIVE MUTING SPRING

BACKGROUND OF THE INVENTION

The present invention relates to an interlocked push-lock push-button switch assembly which is compact in size, inexpensive to manufacture and ensures the smooth switch operation.

Various types of the interlocked push-lock push-button switch assemblies have been devised and demonstrated, but they are not reliable in operation, complex in construction, large in size and expensive to manufacture so that satisfactory switch assemblies are not available.

SUMMARY OF THE INVENTION

In view of the above, one of the present invention is to provide an inerlocked push-lock push-button switch assembly which is compact in size, simple in construction and assembly and inexpensive to manufacture, whereby high productivity may be ensured.

Another object of the present invention is to provide an interlocked push-lock push-button switch assembly in which a bias spring for biasing a sliding locking member in one axial direction may be assembled in one step, whereby high productivity may be ensured.

A further object of the present invention is to provide an interlocked push-lock push-button switch assembly in which the bias spring ensures the reliable and stable operation of the sliding locking member, whereby the excellent switching operation feeling may be attained.

A further object of the present invention is to provide an interlocked push-lock push-button switch assembly in which when the switch is pushed down or released, the movable contacts make slidable contact with the mating stationary contacts, whereby the self-contact-cleaning action may be attained.

A further object of the present invention is to provide an interlocked push-lock push-button switch assembly in which the movable contacts make slidable contact with the curved surfaces of the mating stationary contacts, whereby the stable and smooth switching operation may be ensured.

A further object of the present invention is to provide an interlocked push-lock push-button switch assembly which incorporates a muting switch, whereby the noise produced when the movable contacts are made into contact with or released from the mating stationary contacts may be eliminated.

A further object of the present invention is to provide an interlocked push-lock push-button switch assembly in which a muting switch spring is mounted on the sliding locking member in a predetermined switching distance relationship, whereby the correct switching timing may be ensured.

A further object of the present invention is to provide an interlocked push-lock push-button switch assembly in which the stroke of the sliding locking member is very effectively utilized so that the components of the switches are not exposed outside.

A further object of the present invention is to provide an interlocked push-lock push-button switch assembly in which the movable contacts may be resiliently and positively pressed against the mating stationary contacts under the resilient force of the movable contact member carrying the movable contacts.

Briefly stated, the above and other objects of the present invention may be attained by an interlocked push-lock push-button switch assembly wherein a plurality of operating means each of which is vertically movale and which is provided with first locking means adapted to engage with second locking means of a sliding locking member, are mounted upon a terminal plate having a plurality of stationary contacts mounted thereupon, each operating means having movable-contact-member retaining means formed at the lower portion thereof; an inverted U-shaped movable contact member having movable contacts mounted at both ends thereof is retained in position by said movable-contact-member retaining means; and a frame or housing is provided to enclose therein said plurality of operating means and said terminal plate, whereby when one of said plurality of operating means is depressed, it is locked in position by the engagement of said first locking means with said second locking means and the movable contacts mounted upon said one operating means are made into electrical contact with the mating stationary contacts.

BRIEF DESCRIPTION OF THE DRAWING

Same reference numerals are used to designate similar parts throughout the figures.

DESCRIPTION OF THE PREFERRED EMBODIMENTS

First Embodiment, FIGS. 1 through 8

Figure 1:
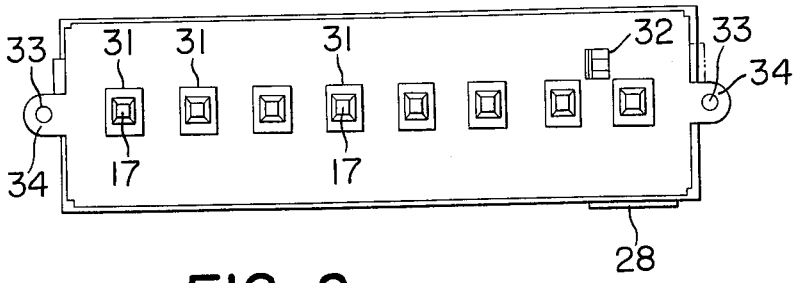
FIG. 1 is a top view of a first embodiment of the present invention.
Figure 2:
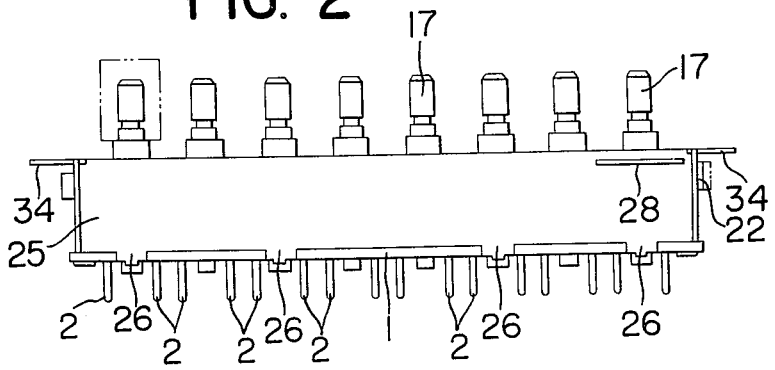
FIG. 2 is a front view thereof.
Figure 3:
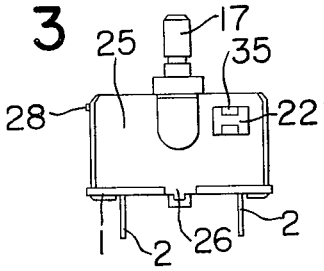
FIG. 3 is a side view thereof.
Figure 4:
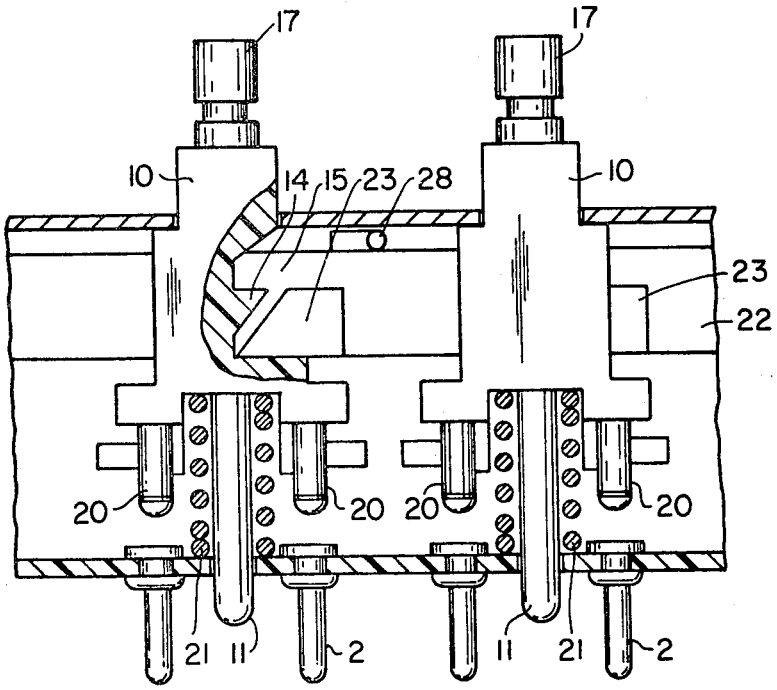
FIG. 4 is a front view thereof with the walls of a frame or housing being partly broken.
Figure 5:
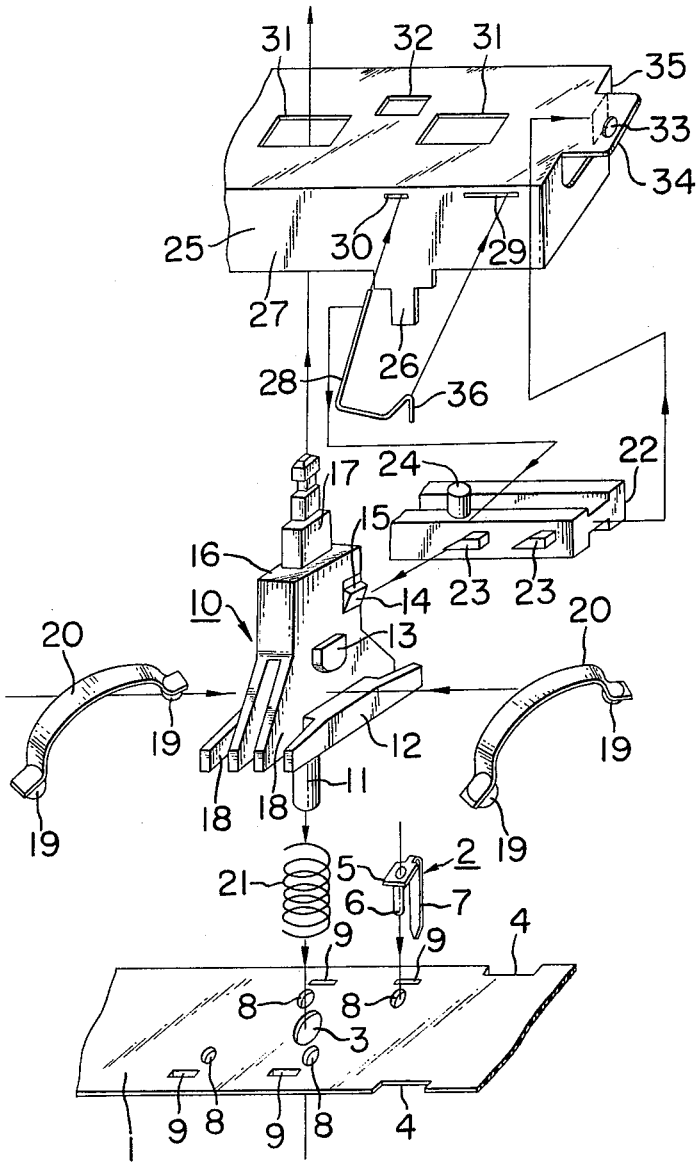
FIG. 5 is an exploded perspective view thereof.
Figure 6:
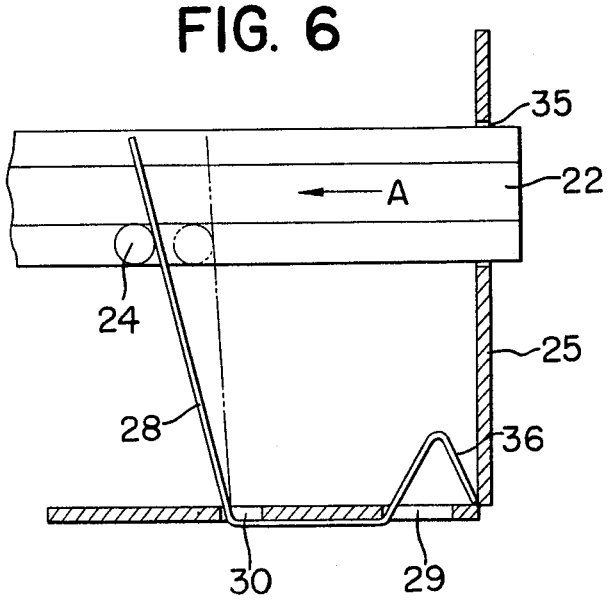
FIG. 6 is a fragmentary view thereof, on enlarged scale.
Figure 7:
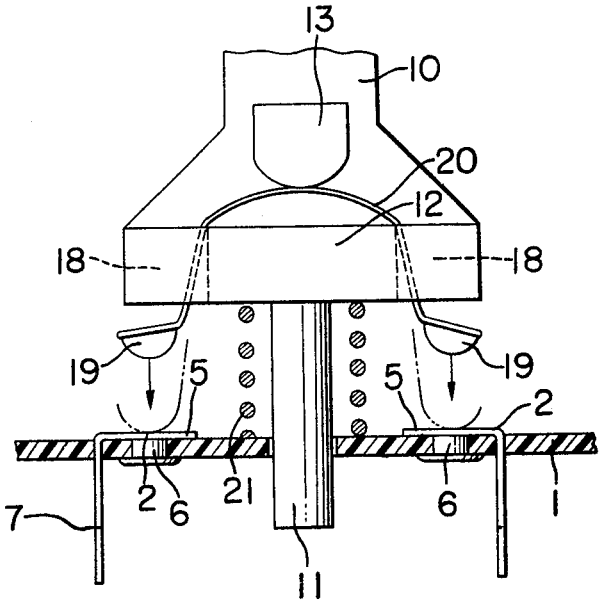
FIGS. 7 and 8 are fragmentary views, on enlarged scale, thereof used for the explanation of the mode of contact between the movable and stationary contacts.
Figure 8:
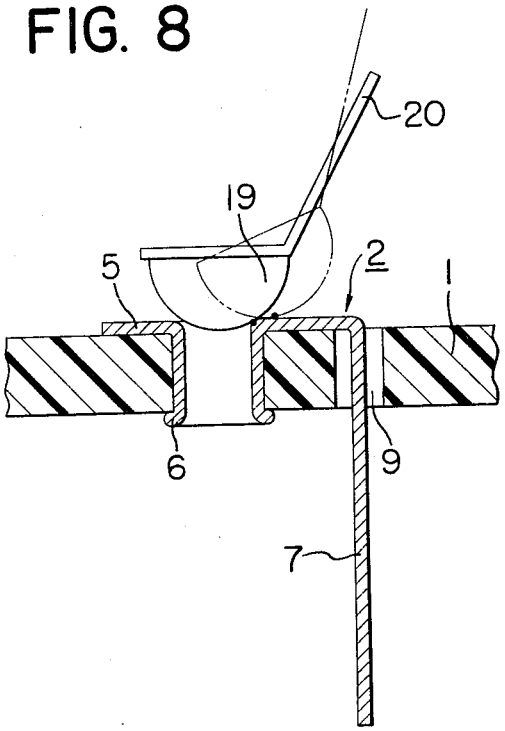

Referring to FIGS. 1 through 8, particularly to FIG. 5, an elongated rectangular terminal plate 1 includes a plurality of stationary contacts 2 arrayed in two rows, a plurality of guide holes 3 formed through the terminal plate 1, spaced apart from each other by a predetermined distance and arrayed in one row along the longitudinal axis of the terminal plate 1 between the rows of the stationary contacts 2, and a suitable number of notches 4 used for assembly with a frame or housing 25 as will be described in more detail hereinafter. As best shown in FIG. 8, each stationary contact 2 consists of a flat stationary contact portion 5 formed integral with an eyelet grommet 6 and a leg or terminal portion 7 folded at a right angle relative to the flat portion 5 and extending downwardly. While the leg or terminal portion 7 is inserted into a rectangular slot 9 formed through the terminal plate 1, the eyelet grommet 6 is fitted into a circular hole 8 formed through the terminal plate 1 and fastened thereto, whereby the stationary contact 2 may be securely mounted on the terminal plate 1.

Referring back to FIG. 5, in the instant embodiment for every two pairs of associated stationary contacts 2, there is provided one operating-bridging member 10 (to be referred to as "the bridging member" hereinafter in this specification for brevity) made of a suitable synthetic resin and formed integral with a guide rod 11 extended downwardly along the axis of the bridging member 10 and adapted to be fitted into the associated guide hole 3 of the terminal plate 1; two movable-contact-member retaining members 12 formed integral with the major surfaces of the bridging member 10 and extending transversely of or at right angles relative to the longitudinal axis of the terminal plate 1 and being spaced apart from the major surfaces by recesses 18; movable contact member retaining projections 13 protruded from the side surfaces; a wedge-shaped first locking projection 14 protruded from one major surface (the right major surface in the instant embodiment) and having a sloping surface 14 and a flat locking surface 15; a stepped flat portion 16 which serves to limit the upward displacement of the bridging member 10; and a knob portion extending axially upwardly from the stepped portion 16.

A movable contact member 20 is made of an elastic metal and carries two semi-spherical movable contacts attached to or formed integral with the ends thereof. As best shown in FIG. 7, the movable contact member 20 is bowed in the form of the inverted U, and is retained in position between the retaining projection 13 and the retaining member 12 in such a way that both the leg portions of the contact member 12 may extend downwardly beyond the recesses 18. The recesses 18 are provided in order to prevent the loosening or release of the movable contact member 12 due to the shocks or vibration. Therefore, alternatively, a suitable portion of the movable contact member 12 may be joined by, for instance, welding to the retaining member 12, whereby the recesses 18 may be eliminated. The surface of the retaining projection 13 in contact with the contact member 12 is curved so as to permit the large deformation or deflection of the movable contact member 12.

The bridging member 10 with two movable contact members 20 mounted thereupon has its guide rod 11 slidably fitted into the guide hole 3 of the terminal plate 1, and a biase coiled spring 21 is fitted over the guide rod 11 so that the bridging member 10 is normally biased upwardly. Other bridging members 10 are the same in construction with that described hereinbefore, and mounted on the terminal plate 1 in the manner described in equidistantly spaced apart relationship.

A plastic sliding locking member 22 which is slidably fitted into rectangular guide holes formed through the side walls of the housing 25, is formed so as to have the H-shaped cross section, whereby the resistance to deformation may be increased. A plurality of second wedge-shaped locking projections 23 are attached to or formed integral with the front surface (that is, the surface adjacent to the bridging member 10) in equidistantly spaced apart relationship, and each second locking projection has a sloping surface adapted to mate with the sloping surface 14 of the first locking projection of the bridging member 10. A plurality of spring stop pins 24 are projected from the top surface of the sliding locking member 22 in equidistantly spaced apart relationship.

The sub-assembly consisting of the terminal plate 1, the bridging members 10 and the sliding locking member 22 is enclosed in the frame or housing 25. The frame or housing 25 is in the form of a box with a front wall 27, a back wall, a top wall and end walls. From the front and back walls are extended ears 26 which engage with the notches 4 of the terminal plate 1 and then are folded inwardly at right angles over the terminal plate 1, whereby the frame or housing may be securely fastened to the terminal plate 1. The front wall 27 is provided with a pair of elongated spring slots 29 and 30 (See FIG. 6) through which is inserted a bias spring 28 as will be described in detail hereinafter. The top wall is provided with a plurality of square openings through which are protruded the knob portions 17 of the bridging members 10, an assembly hole 32 which are used to locate the bias spring in position as will be described in detail hereinafter and two mounting flages 34 each extended in the longitudinal direction from the side where the top wall and the end wall are joined and each provided with mounting hole 33.

As shown in FIG. 6, the bias spring 28 is made of a resilient metal wire, and is folded in the form of L, and the end portion 36 of the horizontal leg is folded in the form of the inverted V. In assembly, the vertical leg portion is inserted through the slot 30 into the frame or housing 25 and is engaged with the spring stop pin 24 while the inverted V-shaped portion 36 is bent or compressed and inserted through the spring slot 29. Then the inverted V-shaped portion returns to its normal shape with the end engages with the corner between the front and side walls. Thus, the bias spring 28 is placed in position in one step.

When the bias spring 28 is loaded in the manner described above, the sliding locking member 22 is normally biased in the direction indicated by the arrow A in FIG. 6 so that the second locking projection 23 of the sliding locking member 22 is in engagement with either the flat surface 15 or the sloping surface 14 of the first locking projection of the bridging member 10. More particularly, when all of the bridging members 10 are in raised position, the second locking projections 23 are in engagement with the sloping surfaces 14 of the first locking projections of the bridging members 10 as shown in FIG. 4. However, when one of the bridging members 10 is depressed against the bias spring 21, the sloping surface of the first locking projection pushes the second locking projection 23 of the sliding locking member 22 so that the latter is displaced in the direction opposite to that indicated by the arrow A in FIG. 6. When the flat surface 15 of the first projection is aligned with the lower end of the sloping surface of the second locking projection 23, the latter is disengaged from the sloping surface 14 of the first locking projection so that the sliding locking member 22 is displaced in the direction indicated by the arrow A and the second locking projection 23 engages with the flat surface portion 15 of the first locking projection. Therefore, the upward movement of the bridging member 10 may be prevented.

As the bridging member 10 is pushed down in the manner described above, the movable contact member 20 is displaced downwardly from the position shown in FIG. 7 to the position shown in FIG. 8. That is, as soon as the movable contact member 20 bridges between the pair of stationary contacts 5, the electrical connection therebetween may be established. Even after the movable contacts 19 have been made into contact with the stationary contacts 5, the bridging member 10 is displaced further downwardly so that the movable contacts 19 slide over the stationary contacts 5 outwardly until they pass over the smoothly curved edges of the eyelets 6 and are received therein as shown in FIG. 8. Since the bridging member 10 reaches the end of the downward stroke and is locked in position, the movable contacts 19 remain seaing in the eyelets 6. Thus, two switching circuits or two pairs of the stationary contacts are closed.

Next when another bridging member 10 is pushed down, the first locking projection 14 thereof pushes the second locking projection 23 to cause the sliding locking member 22 to be displaced in the direction opposite to that indicated by the arrow A in the manner described above so that the first locking projection 14 of the bridging member 10 which has been previously locked in position is released. As a result, the bridging member 10 is returned to the initial or raised position under the force of the bias coiled spring 21. When the moving contacts 19 are released from their mating stationary contacts 5, the former slide over the latter so that the self-cleaning action between them may be attained.

When another bridging member 10 is further depressed, it is locked in position in the manner described above so that the switching circuits or stationary contacts associated with this bridging member 10 may be closed.

Second Embodiment, FIGS. 9 through 12

In the switch assembly in accordance with the first embodiment of the present invention, noise is produced when the movable contacts are made into contact with or released from the stationary contacts. To overcome this noise problem, a muting switch is incorporated in the second embodiment of the present invention which muting switch is closed instantaneously immediately before the switch which has been on is opened and is opened instantaneously immediately after another switch is closed. Such muting switch must be actuated with the precise timing and must be made compact in size.

Figure 9:
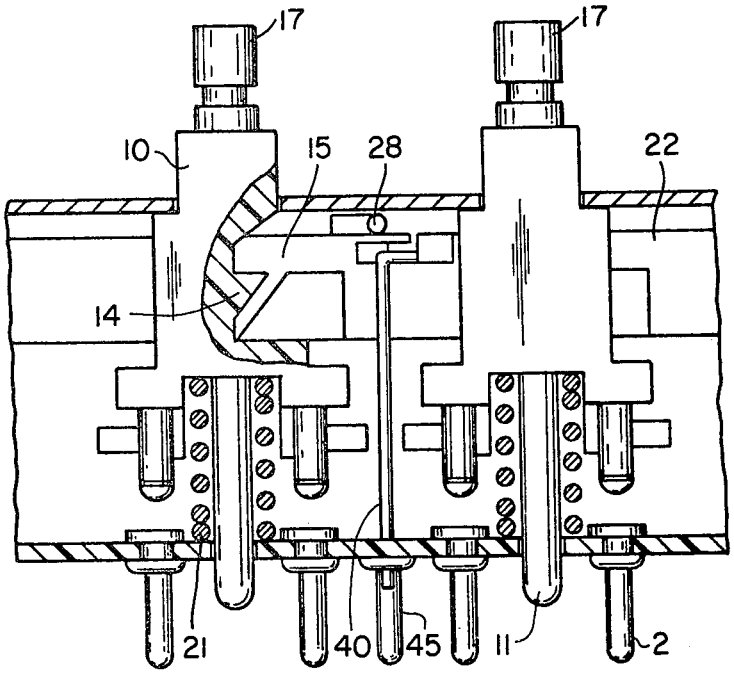
FIG. 9 is a fragmentary view, partly broken of a second embodiment of the present invention.
Figure 10:
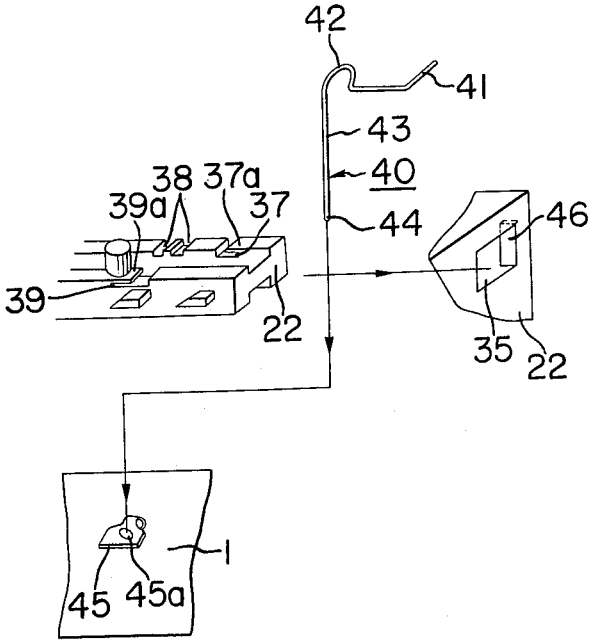
FIG. 10 is an exploded perspective view illustrating major parts thereof.
Figure 11:
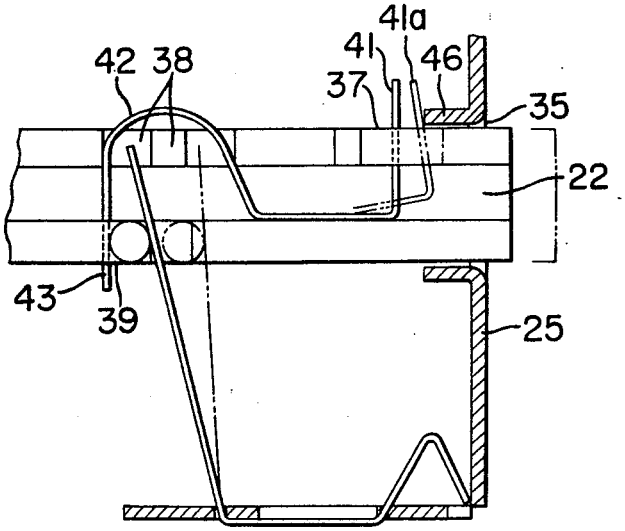
FIG. 11 is a fragmentary view, on enlarged scale, thereof, used for the explanation of a muting switch spring.

The second embodiment shown in FIGS. 9, 10 and 11 are substantially similar in construction to the first embodiment except that it incorporates a muting switch. As shown in FIGS. 10 and 11, the top surfaces of the sliding locking member 22 are provided with an L-shaped spring retaining notch 37 with an overhanging wall 37*a*, spring retaining notches 38 and a reversed-L-shaped spring retaining notch 39 with an overhanging wall 39*a*. As best shown in FIG. 11, one end portion 41 of a muting switch spring 40, which is made od an electrically conductive and resilient material, is bent at a right angle and is inserted into the L-shaped notch 37; that is, the horizontal slot portion (See FIG. 10); the portion 42 bowed in the form of the semi-circle are inserted into the notches 38; and the straight portion 43 is inserted into the reversed-L-shaped notch 39 and is folded downwardly so that the other end portion 44 is inserted into the hole 45*a* of a muting switch contact 45 (See FIG. 10) mounted on the terminal plate 1 and is resiliently pressed against it. The muting switch spring 40 is so bent, folded or bowed that the portions thereof inserted into the spring retaining notches 37, 38 and 39 may be resiliently pressed against the notches and securely held in position. Since the portions 41 and 43 of the spring 40 are inserted into the horizontal leg or slot portions of the notches 37 and 39, their displacement in any directions may be positively limited by the overhanding walls 37*a* and 39*a*.

Referring to FIG. 10, a protrusion 46 is struck out inwardly from one side of the guide opening 35 in the right side wall of the frame or housing 25 so that, as shown in FIG. 11, when the sliding locking member 22 is displaced to the right against the bias spring 36 in the manner described above, one end portion 41 of the muting switch spring 40 is made into contact with the protrusion 46, whereby the frame or housing 25 may be electrically connected to the muting switch contact 45 on the terminal plate 1. When one end portion 41 of the muting switch spring 40 is made into engagement with the protrusion 46, the one end portion 41 is caused to be bent inwardly and to partly float from the sliding locking member 22 so that the one end portion 41 may be firmly and resiliently pressed against the protrusion 46. Thus, the reliable and stable electrical contact between the muting switch spring 40 and the protrusion 46 hence the frame or housing 25 may be ensured.

Figure 12:
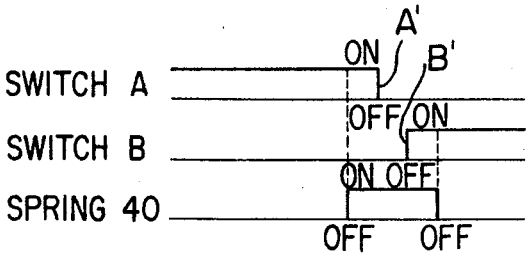
FIG. 12 is a timing chart used for the explanation of the muting switch spring.

Next referring to FIG. 12, the mode of operation of the muting switch with the above construction will be described. Noise is produced at a time A′ when the switch A is turned off and at a time B′ when the switch B is turned on. Therefore, the muting switch spring 40 is so actuated as to bridge between the ON time A′ and the OFF time B′. That is, the muting switch spring 40 is made into contact with the protrusion 46 immediately before the switch A is turned off, and then released from the protrusion 46 immediately after the switch B is turned on.

So far the muting switch spring 40 has been described as being resiliently retained in the nothces 37, 38 and 39 of the sliding locking member 22 and as being made into electrical connection with the protrusion 46 struck out of the frame or housing 25, but it will be understood that the muting switch spring 40 may be mounted on the sliding locking member 22 in such a way that when the latter is displaced to the right in FIG. 11, one end of the spring 40 is made into contact with an electrically conducting portion of the frame or housing 25 while the other end is made into contact with the muting switch terminal 45.

What is claimed is:

1. An interlocked push-lock pushbutton assembly, comprising:

a plurality of operating means each of which (i) is vertically movable and (ii) is provided with first locking means adapted to engage a corresponding second locking means of a sliding locking member, said sliding locking member having a separate one of said second locking means for engaging the first locking means of each of said operating means to selectively lock the corresponding operating means in a predetermined vertical position, a movable contact member retaining means formed at the lower portion of each of said plurality of operating means with recesses at both ends thereof, and a movable contact member retaining projection means protruding from said operating means above the midpoint of said movable contact member retaining means, a movable contact member made of an electrically conductive and resilient material, and formed in inverted U-shaped form, the leg portions of said inverted U-shaped movable contact member being inserted into said recesses, and the bow-shaped portion of said movable contact member being pressed against said movable contact member retaining projection, a terminal plate having a plurality of stationary contacts mounted thereon, and a housing provided to enclose therein said plurality of operating means cooperating with said terminal plate, said movable contact members, said sliding locking member, said plurality of operating means, and said stationary contacts being disposed within said housing, whereby said inverted U-shaped movable contact members may be selectively resiliently pressed against the mating stationary contacts.

2. An interlocked push-lock pushbutton assembly, comprising:

a plurality of operating means each of which (i) is vertically movable and (ii) is provided with first locking means adapted to engage a corresponding second locking means of a sliding locking member, said sliding locking member having a separate one of said second locking means for engaging the first locking means of each of said operating means to selectively lock the corresponding operating means in a predetermined vertical position, a movable contact member retaining means formed at the lower portion of each of said plurality of operating means with recesses at both ends thereof, and a movable contact member retaining projection means protruding from said operating means above the midpoint of said movable contact member retaining means, a movable contact member made of an electrically conductive and resilient material and secured to each of said operating means by means of the corresponding recesses and retaining projection means, said contact member having movable contacts mounted at both ends thereof, and a terminal plate having a plurality of stationary contacts mounted thereon, each of said stationary contacts having an eyelet with a curved circumferential ridge portion, wherein a corresponding movable contact of said movable contact member makes a slidable contact with said eyelet when the movable contact is pressed against the stationary contact.

3. An interlocked push-lock push-button switch assembly as set forth in claim 2 wherein said stationary contact formed integral with an eyelet grommet passing through said eyelet is fastened to said terminal plate, whereby the mating movable contact is received in said eyelet grommet and is made into electrical contact with said curved circumferential ridge portion thereof.

4. An interlocked push-lock pushbutton assembly, comprising:

a plurality of operating means each of which (i) is vertically movable and (ii) is provided with first locking means adapted to engage a corresponding second locking means of a sliding locking member, said sliding locking member having a separate one of said second locking means for engaging the first locking means of each of said operating means to selectively lock the corresponding operating means in a predetermined vertical position, a movable contact member retaining means formed at the lower portion of each of said plurality of operating means with recesses at both ends thereof, and a movable contact member retaining projection means protruding from said operating means above the midpoint of said movable contact member retaining means, a movable contact member made of an electrically conductive and resilient material and having movable contacts mounted at both ends thereof, secured to each of said operating means by the recesses and retaining projection means thereof, a terminal plate having a plurality of stationary contacts mounted thereon adjacent corresponding ones of said movable contacts, a housing provided to enclose therein said plurality of operating means cooperating with said terminal plate, said movable contact members and said stationary contacts being disposed within said housing, said housing being provided with elongated slots, and the vertical leg portion of an L-shaped bias spring being inserted into said housing through one of said elongated slots, said bias spring being retained in position thereby and engaging said sliding locking member, the end portion of the horizontal leg of said L-shaped spring being folded in the form of an inverted V and inserted into said housing through another elongated slot for engagement with the inner wall surface of said housing, whereby said sliding locking member may be normally biased in a given axial direction.

5. An interlocked pushbutton switch assembly, comprising a terminal plate having a plurality of pairs of stationary contacts mounted thereon;

a housing adjacent said terminal plate;

a sliding locking member within said housing, said member being mounted for sliding movement parallel to said terminal plate and having a plurality of locking means thereon;

a plurality of operating members within said housing and mounted for vertical movement in a direction normal to said terminal plate, each of said operating members having at least one movable-contact-member retaining means formed therein, said retaining means comprising (i) a pair of recesses formed in the portion of each of said operating members adjacent said terminal plate and (ii) a movable-contact-member retaining projection protruding from said operating member and disposed vertically above said recesses and at the midpoint between said recesses; and an electrically conductive and resilient movable contact member having an inverted U-shaped configuration, with a movable-contact adjacent each end thereof, said contact member having a central bowshaped portion abutting said projection and leg portions disposed in said recesses, so that when said operating member is held in a position adjacent said terminal plate by engagement of the locking means of said operating member with the corresponding locking means of said sliding locking member, the movable contacts of said contact member engage corresponding ones of a pair of said stationary contacts, and said contact member is urged toward said stationary contacts solely by said projection.

6. An interlocked push-button switch assembly as set forth in claim 5 wherein said movable contacts are formed integral with said movable contact member, and the portions thereof which contact the stationary contacts are curved.

7. An interlocked push-button switch assembly as set forth in claim 5 wherein each of said stationary contacts has a curved portion where the movable contact of said movable contact member makes a slidable contact when the movable contact is pressed against the stationary contact.

8. An interlocked push-button switch assembly as set forth in claim 7 wherein said stationary contact is formed integral with an eyelet grommet fastened to said terminal plate, said grommet having a circumferential ridge portion, so that the mating movable contact is received in said eyelet grommet and is made into electrical contact with the circumferential ridge portion thereof.

9. An interlocked pushbutton switch assembly, comprising a terminal plate having a plurality of pairs of stationary contacts mounted thereon;

a housing adjacent said terminal plate;

a sliding locking member within said housing, said member being mounted for sliding movement parallel to said terminal plate and having a plurality of locking means thereon;

a plurality of operating members within said housing and mounted for vertical movement in a direction normal to said terminal plate, each of said operating members having locking means adjacent a corresponding locking means of said sliding locking member, each of said operating members having at least one movable-contact-member retaining means formed therein adjacent said terminal plate;

an inverted U-shaped movable contact member having two movable contacts adjacent corresponding ones of a pair of said stationary contacts, said contact member being retained in position by said retaining means;

said housing having at least two adjacent slots elongated in a direction parallel to said terminal plate;

an L-shaped bias spring having first and second leg portions, said first leg portion extending into said housing through one of said slots and engaging said sliding locking member to urge said locking member in a direction parallel to said terminal plate, said second leg having an inverted V-shaped portion extending into the other of said slots to retain said spring in position;

a muting switch spring comprising an electrically conductive and resilient material mounted on said sliding locking member for movement therewith, said housing having an electrically conductive part, one end of said muting spring being disposed adjacent said part for electrical contact therewith when said sliding locking member is displaced as a result of engagement of said locking means thereof with the locking means of one of said operating members; and means for providing an electrical connection to a portion of said muting spring remote from said end thereof.

10. An interlocked push-lock push-button switch assembly as set forth in claim 9 wherein the width of said inverted V-shaped portion of said bias spring is longer than that of said other elongated slot; and the free end of said inverted V-shaped portion is made into contact with the inner wall surface of said frame or housing in such a way that the extension of said inverted V-shaped portion may be prevented.

11. An interlocked push-lock push-button switch assembly as set forth in claim 9 wherein said bias spring is so inserted through said elongated slots that said bias spring may snap in.

12. An interlocked push-lock push-button switch assembly as set forth in claim 9 wherein said muting switch spring is retained in position in notches formed in said sliding locking member under the resilient force of said muting switch spring.

* * * * *

UNITED STATES PATENT OFFICE

CERTIFICATE OF CORRECTION

Patent No. 4,095,059 Dated June 13, 1978

Inventor(s) Matsuo Nishioka, et al

It is certified that error appears in the above-identified patent and that said Letters Patent are hereby corrected as shown below:

Column 1, line 19: "one" should be --one object--.

line 20: "inerlocked" should be --interlocked--.

Column 2, line 5: "movale" should be --movable--.

Column 3, line 48: "biase" should be --bias--.

Column 4, line 16: "are" should be --is--.

line 31: "engages" should be --engaged--.

Column 5, line 8: "seaing" should be --seated--.

line 53: "od" should be --of--.

line 57: "are" should be --is--.

Column 6, line 3: "handing" should be --hanging--.

line 4: "struck out" should be --bent--.

UNITED STATES PATENT OFFICE

CERTIFICATE OF CORRECTION

Patent No. 4,095,059 Dated June 13, 1978

Inventor(s) Matsuo Nishioka, et al

It is certified that error appears in the above-identified patent and that said Letters Patent are hereby corrected as shown below:

Column 6, line 34: "nothces" should be --notches--.

line 36: "struck" should be --bent--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*